US008312944B2

(12) United States Patent
Marshall et al.

(10) Patent No.: US 8,312,944 B2
(45) Date of Patent: Nov. 20, 2012

(54) PERCUSSION HAMMER BIT WITH A DRIVER SUB INCLUDING A GUIDE SLEEVE PORTION

(75) Inventors: Alan J. Marshall, Lost Creek, WV (US); Shantanu Swadi, Cypress, TX (US); Michael Krauel, Houston, TX (US)

(73) Assignee: Smith International, Inc., Houston, TX (US)

( * ) Notice: Subject to any disclaimer, the term of this patent is extended or adjusted under 35 U.S.C. 154(b) by 631 days.

(21) Appl. No.: 12/360,924

(22) Filed: Jan. 28, 2009

(65) Prior Publication Data

US 2010/0187016 A1 Jul. 29, 2010

(51) Int. Cl.
*E21B 10/36* (2006.01)

(52) U.S. Cl. ..... 175/414

(58) Field of Classification Search ..... 175/293–306, 175/414; 279/20; 403/253, 254, 309, 310; 173/123
See application file for complete search history.

(56) References Cited

U.S. PATENT DOCUMENTS

| | | | | |
|---|---|---|---|---|
| 3,712,388 | A * | 1/1973 | Curington | 173/78 |
| 4,630,958 | A * | 12/1986 | McCallister | 403/257 |
| 5,065,827 | A * | 11/1991 | Meyers et al. | 175/414 |
| 5,803,192 | A * | 9/1998 | Holte | 175/296 |
| 6,290,424 | B1 * | 9/2001 | Purcell | 403/328 |
| 6,464,023 | B2 * | 10/2002 | Patterson | 175/93 |
| 6,550,554 | B2 * | 4/2003 | Gien | 175/296 |
| 7,395,883 | B2 * | 7/2008 | Beccu | 175/415 |
| 2008/0078584 | A1 * | 4/2008 | Lyon | 175/171 |
| 2008/0185187 | A1 * | 8/2008 | Scott et al. | 175/320 |
| 2010/0059284 | A1 * | 3/2010 | Lyon et al. | 175/296 |
| 2010/0108395 | A1 * | 5/2010 | Purcell | 175/296 |

FOREIGN PATENT DOCUMENTS

WO WO 2007010513 A1 * 1/2007

OTHER PUBLICATIONS

Dictionary definition of "align", accessed Mar. 26, 2012 via thefreedictionary.com.*
Mincon Rockdrills; "MCClass DTH Hammers"; "The Next Evolution in DTH Drilling"; (1 page).

* cited by examiner

*Primary Examiner* — Daniel P Stephenson
*Assistant Examiner* — Blake Michener
(74) *Attorney, Agent, or Firm* — Osha • Liang LLP

(57) ABSTRACT

A percussion drilling assembly for boring into the earth. In an embodiment, the assembly comprises a tubular case having a central axis, an upper end, and a lower end. In addition, the assembly comprises a piston slidingly disposed within the tubular case. Further, the assembly comprises a driver sub coaxially coupled to the lower end of the tubular case. The driver sub includes an upper end disposed within the case and a lower end extending axially from the lower end of the case. Still further, the assembly comprises a hammer bit coaxially disposed within the driver sub. The hammer bit including an upper end disposed within the driver sub and a lower end extending from the lower end of the driver sub. The upper end of the driver sub extends axially from the upper end of the hammer bit and is adapted to receive the piston.

13 Claims, 6 Drawing Sheets

PERCUSSION HAMMER BIT WITH A DRIVER SUB INCLUDING A GUIDE SLEEVE PORTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The disclosure relates generally to earth boring bits used to drill a borehole for applications including the recovery of oil, gas or minerals, mining, blast holes, water wells and construction projects. More particularly, the disclosure relates to percussion hammer drill bit assemblies. Still more particularly, the disclosure relates to percussion hammer drill bit assemblies including a driver sub with a guide sleeve portion.

2. Background of Related Art

In percussion or hammer drilling operations, a drill bit mounted to the lower end of a drillstring simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target formation. The borehole created will have a diameter generally equal to the diameter or "gage" of the drill bit.

Referring to FIGS. 1-3, a conventional percussion drilling assembly 10 for drilling through formations of rock to form a borehole is shown. Assembly 10 is connected to the lower end of a drillstring 11 (FIG. 3) and extends along a central longitudinal axis 15. Assembly 10 includes a top sub 20, a driver sub 40, a tubular case 30 axially disposed between top sub 20 and driver sub 40, a piston 35 slidably disposed in the tubular case 30, and a hammer bit 60 slidingly received by driver sub 40. A feed tube 50 extends between top sub 20 and piston 35.

The upper end of top sub 20 is threadingly coupled to the lower end of drillstring 11 (FIG. 3), and the lower end of top sub 20 is threadingly coupled to the upper end of case 30. Further, the lower end of case 30 is threadingly coupled to the upper end of driver sub 40. As previously described, hammer bit 60 is slidingly disposed within driver sub 40. In particular, a series of axial mating splines 61, 41 on bit 60 and driver sub 40, respectively, allow bit 60 to move axially relative to driver sub 40 while simultaneously allowing driver sub 40 to rotate bit 60 along with drillstring 11 and case 30.

Hammer bit 60 is generally cylindrical in shape and includes a radially outer skirt surface 62 aligned with or slightly recessed from the borehole sidewall and a bottomhole facing bit face 64. The earth disintegrating action of the hammer bit 60 is enhanced by providing a plurality of cutting elements (not shown) that extend from the cutting face 64 for engaging and breaking up the formation. The cutting elements are typically inserts formed of a superhard or ultrahard material, such as polycrystalline diamond (PCD) coated tungsten carbide and sintered tungsten carbide, that are press fit into undersized apertures in bit face.

A guide sleeve 32 and a bit retainer ring 34 are disposed in case 30 axially above driver sub 40. The upper end of guide sleeve 32 slidingly receives the lower end of piston 35 and the lower end of guide sleeve 32 slidingly receives the upper end of hammer bit 60. Bit retainer ring 34 is disposed about the upper portion of hammer bit 60 axially between driver sub 40 and guide sleeve 32. Bit retainer ring 34 extends radially into an annular recess in the outer surface of hammer bit 60 proximal its upper end, and prevents hammer bit 60 from falling out of and completely disengaging driver sub 40.

A retainer sleeve 70 is coupled to driver sub 40 and extends axially downward from driver sub 40 along the outer periphery of hammer bit 60. Retainer sleeve 70 generally provides a secondary catch mechanism that allows the lower enlarged head of hammer bit 60 to be extracted from the wellbore upon lifting of the drillstring 11 and percussion drilling assembly 10 in the event of a crack or break in the shank (rotational drive) section of bit 60.

During drilling operations, a compressed fluid (e.g., compressed air, compressed nitrogen, etc.) is delivered down the drillstring 11 from the surface to percussion drilling assembly 10. In most cases, the compressed fluid is provided by one or more compressors at the surface. The compressed fluid serves to axially actuate piston 35 within case 30. As piston 35 moves reciprocally within case 30, it cyclically impacts hammer bit 60, which in turn cyclically impacts the formation to gouge, crush, and break the formation with the cutting elements mounted thereon. The compressed fluid ultimately exits the bit face 64 and serves to flush cuttings away from the bit face 64 to the surface through the annulus between the drillstring and the borehole sidewall.

During drilling operations, drillstring 11 and drilling assembly 10 are rotated. Mating splines 41, 61 on driver sub 40 and bit 60, respectively, allow bit 60 to move axially relative to driver sub 40 while simultaneously allowing driver sub 40 to rotate bit 60 with drillstring 11. As a result, the drillstring rotation is transferred to the hammer bit 60. Rotary motion of the drillstring 11 may be powered by a rotary table typically mounted on the rig platform or top drive head mounted on the derrick. The rotation of hammer bit 60 allows the cutting elements of bit 60 to be "indexed" to fresh rock formations during each impact of bit 60, thereby improving the efficiency of the drilling operation. Without indexing, the cutting structure extending from the lower face 64 of the hammer bit 60 may have a tendency to undesirably impact the same portion of the earth as the previous impact. Experience has demonstrated that for an eight inch hammer bit (e.g., hammer bit 60), a rotational speed of approximately 20 RPM (revolutions per minute) and an impact frequency of approximately 1600 BPM (beats per minute) typically result in relatively efficient drilling operations. This rotational speed translates to an angular displacement of approximately 5 to 10 degrees per impact of the bit against the rock formation.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole section by section. Once the drillstring has been retrieved and the new bit installed, the bit must be lowered to the bottom of the borehole on the drillstring, which again must be constructed section-by-section. As is thus obvious, this process, known as a "trip" of the drillstring, requires considerable time, effort and expense.

As previously described, in most conventional hammer bit assemblies, the driver sub (e.g., driver sub 40) and the guide sleeve (e.g., guide sleeve 32) are manufactured and installed as separate and distinct components that are axially spaced apart by the retainer ring (e.g., retainer ring 34). The driver sub and guide sleeve are typically designed and manufactured to include dimensional tolerances sufficient to allow for some movement, both axial and radial movement, within the percussion drilling assembly (e.g., assembly 10). During drilling operations, the repeated impacts and vibrations often causes the guide sleeve and the driver sub to move axially within the assembly. Such movements may result in undesirable surface wear of the driver sub and the guide sleeve, thereby increasing the tolerances and spacing with neighboring components and further exacerbating the movement and associated wear of the driver sub and the guide sleeve. Thus, over extended drilling operations, the relative movement and vibration of the guide sleeve and the driver sub often results in the undesirable and detrimental wear to the surfaces of the driver sub and the guide sleeve, thereby increasing the tolerances and gaps between the guide sleeve, the driver sub, and the surrounding components of the assembly. These increased tolerances allow for increased relative movement and associated wear, thereby promoting a vicious cycle that may potentially lead to breakage and/or damage to the driver sub, the bit retainer rings, the guide sleeve, or combinations thereof. Once the driver sub or guide sleeve is damaged, the entire drillstring (e.g., drillstring 11) must be pulled to replace the damaged component(s). Moreover, if the wear between the mating components is substantial, the timing of the hammer may be adversely affected, thereby reducing drilling efficiency.

Accordingly, there is a need for devices and methods that enhance the durability of a percussion drilling assembly. Such devices and methods would be particularly well received if they were relatively inexpensive, simple to manufacture, and did not otherwise interfere with the operation of the percussion drilling assembly.

BRIEF SUMMARY OF SOME OF THE EMBODIMENTS

These and other needs in the art are addressed in one embodiment by a percussion drilling assembly for boring into the earth. In an embodiment, the assembly comprises a tubular case having a central axis, an upper end, and a lower end. In addition, the assembly comprises a piston slidingly disposed within the tubular case. Further, the assembly comprises a driver sub coaxially coupled to the lower end of the tubular case. The driver sub including an upper end disposed within the case and a lower end extending axially from the lower end of the case. Still further, the assembly comprises a hammer bit coaxially disposed within the driver sub. The hammer bit including an upper end disposed within the driver sub and a lower end extending from the lower end of the driver sub. Moreover, the upper end of the driver sub extends axially from the upper end of the hammer bit and is adapted to receive the piston.

These and other needs in the art are addressed in another embodiment by a percussion drilling assembly for boring into the earth. In an embodiment, the assembly comprises a tubular case having a central axis, an upper end, and a lower end. In addition, the assembly comprises a piston slidingly disposed in the tubular case. Further, the assembly comprises a driver sub connected to the lower end of the tubular case. Still further, the assembly comprises a hammer bit coaxially disposed within the driver sub, the hammer bit including an upper end disposed within the driver sub and a lower end extending from the lower end of the driver sub. Moreover, the assembly comprises a bit retainer ring radially disposed between an inner surface of the driver sub and an outer surface of the hammer bit.

These and other needs in the art are addressed in another embodiment by a method for assembling a percussion drilling assembly. In an embodiment, the method comprises slidingly receiving an upper end of a hammer bit into a driver sub. The hammer bit has an outer surface including an annular recess and the driver sub has an inner surface including an annular recess. In addition, the method comprises advancing the hammer bit axially through the driver sub until the annular recess of the driver sub aligns with the annular recess of the hammer bit. Further, the method comprises positioning a bit retainer ring radially between the driver sub and the hammer bit after advancing the hammer bit axially through the driver sub until the annular recess of the driver sub aligns with the annular recess of the hammer bit.

Thus, embodiments described herein comprise a combination of features and advantages intended to address various shortcomings associated with certain prior assemblies, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF SOME OF THE EMBODIMENTS

Figure 1:
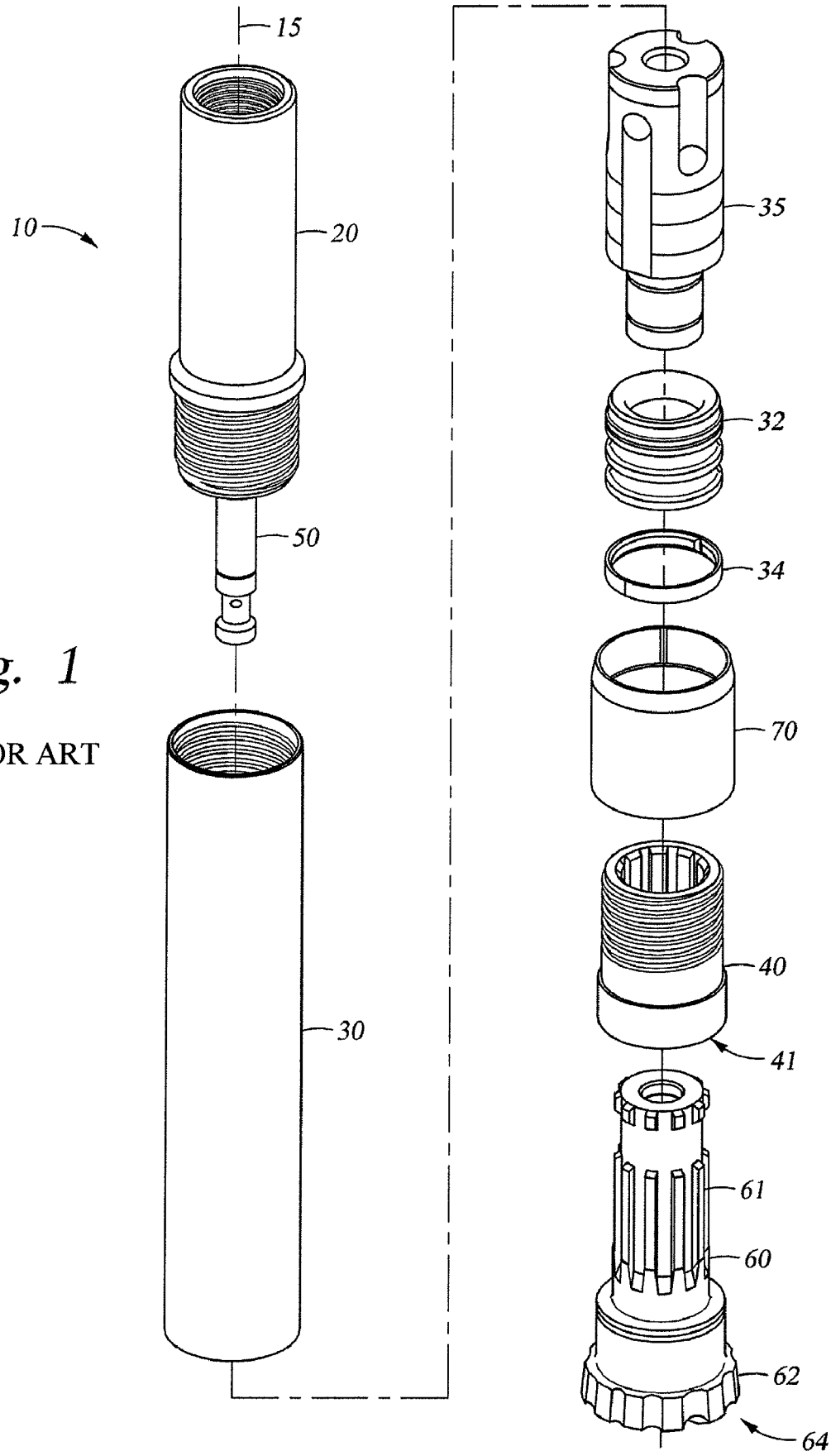
Fig. 1 PRIOR ART
FIG. 1 is an exploded perspective view of a conventional percussion drilling assembly.
Figure 2:
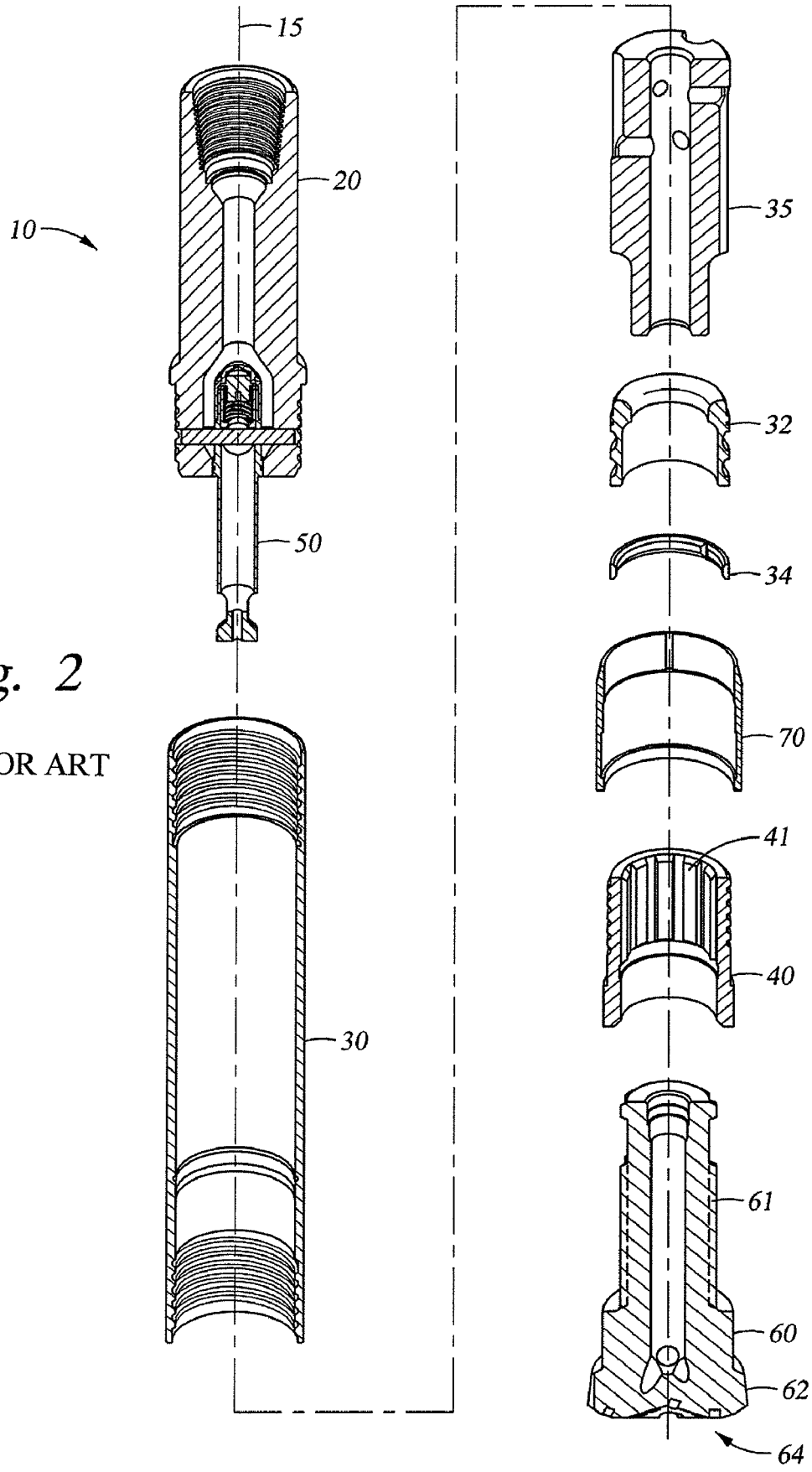
Fig. 2 PRIOR ART
FIG. 2 is an exploded, cross-sectional view of the percussion drilling assembly of FIG. 1.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different names may refer to the same feature or component. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Figure 4:
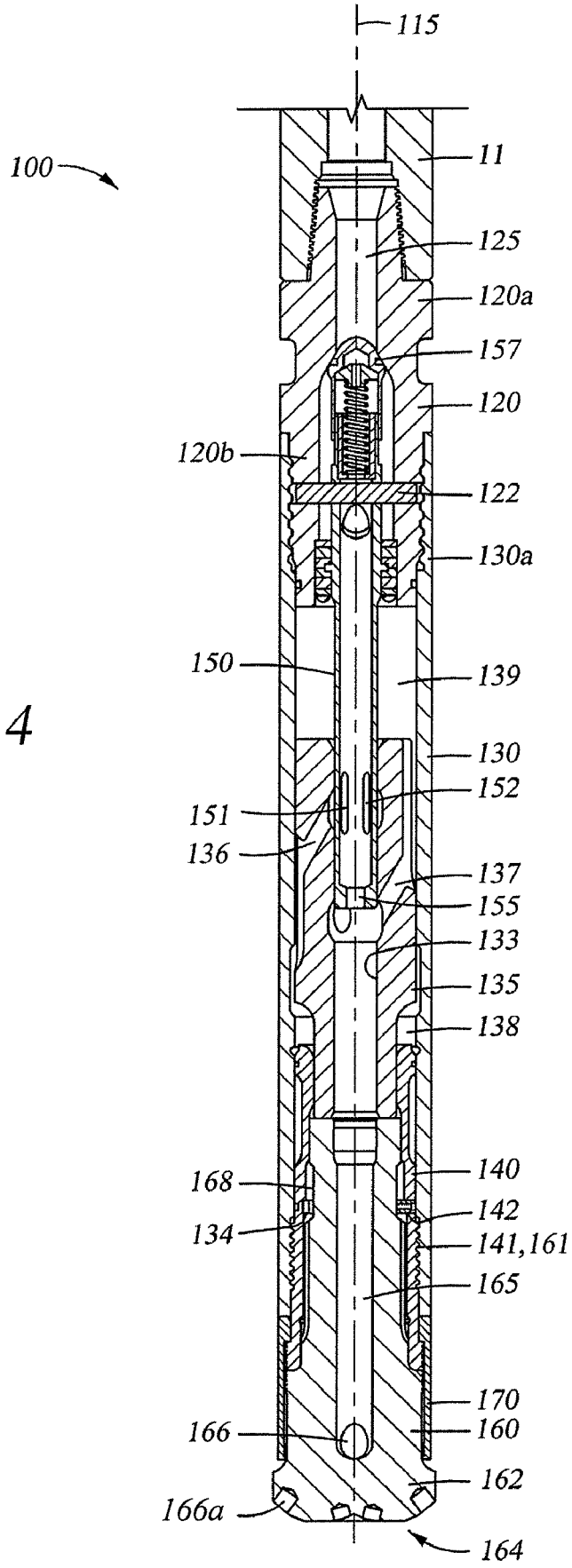
FIG. 4 is a cross-sectional view of an embodiment of a percussion drilling assembly in accordance with the principles described herein.
Figure 5:
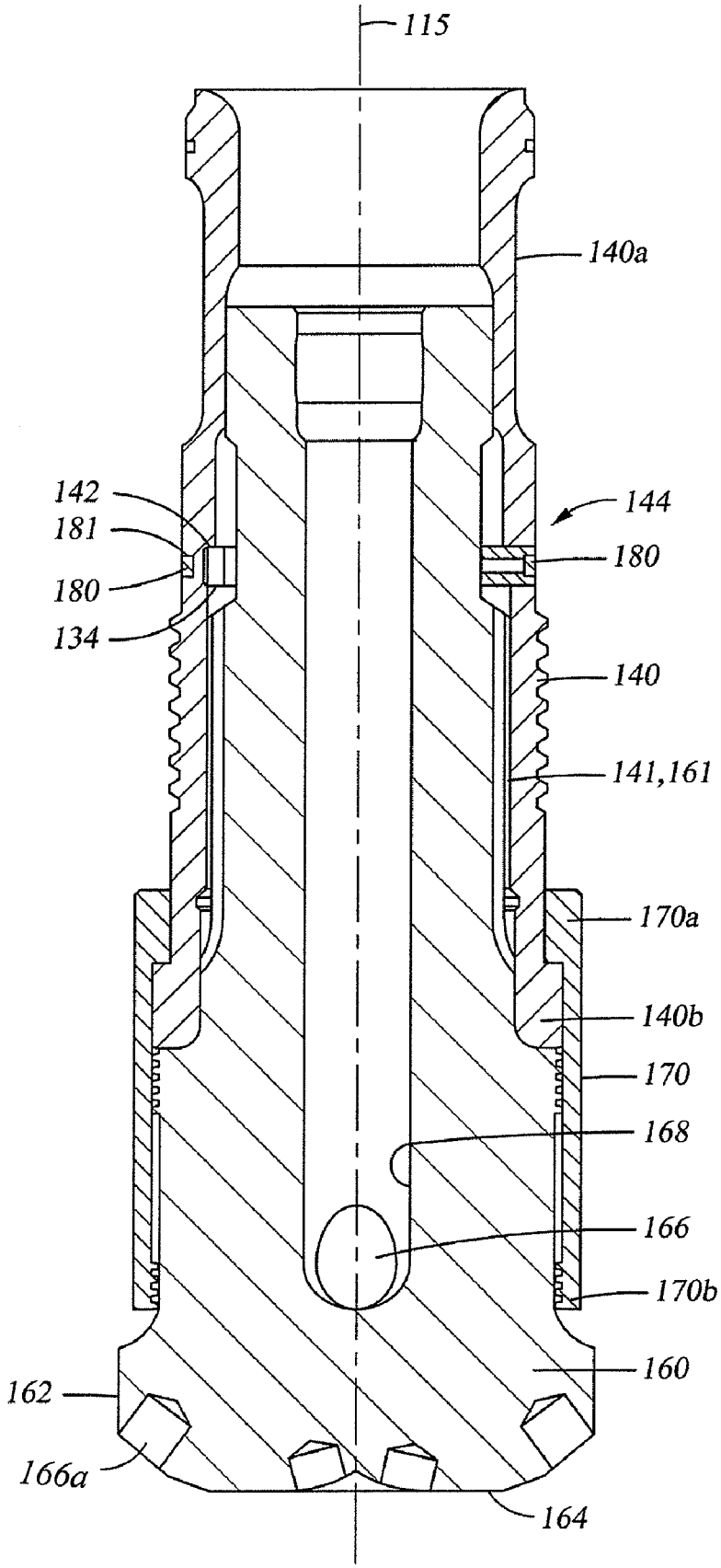
FIG. 5 is an enlarged partial cross-sectional view of the percussion drilling assembly of FIG. 4.

Referring now to FIGS. 4 and 5, an embodiment of a percussion drill bit assembly 100 in accordance with the principles described herein is shown. Assembly 100 is employed to drill through formations of rock to form a borehole for the ultimate recovery of oil and gas. Assembly 100 is connected to the lower end of a drillstring 11 (FIG. 4) and includes a top sub 120, a driver sub 140, a tubular case 130 axially disposed between top sub 120 and driver sub 140, a piston 135 slidably disposed within tubular case 130, and a hammer bit 160 slidingly received by driver sub 140.

Top sub 120 has an upper end 120*a* and a lower end 120*b*, and case 130 has an upper end 130*a* and a lower end 130*b*. Upper end 120*a* of top sub 120 is threadingly coupled to the lower end of drillstring 11, and lower end 120*b* of top sub 120 is threadingly coupled to upper end 130*a* of case 130. Further, lower end 130*b* of case 130 is threadingly coupled to driver sub 140. A fluid conduit 150 extends between top sub 120 and piston 135. Hammer bit 160 has an upper end 160*a* slidingly received by driver sub 140 and a lower end 160*b* extending from driver sub 140. Lower end 160*b* comprises a formation engaging skirt 162 and a formation engaging bit face 164. Top sub 120, case 130, piston 135, driver sub 140, and hammer bit 160 are generally coaxially aligned, each sharing a common central longitudinal axis 115.

Driver sub 140 is disposed within case 130 generally about hammer bit 160 and includes an upper end 140*a* and a lower end 140*b*. Upper end 140*a* extends axially from upper end 160*a* of hammer bit 160 and slidingly receives the lower end of piston 135. Thus, driver sub 140 is positioned radially between case 130 and hammer bit 160, but extends axially beyond upper end 160*a* of hammer bit 160. As upper end 140*a* of driver sub 140 receives and "guides" the lower end of piston 135, it serves the function of, and effectively replaces, the distinct and separate guide sleeve employed in conventional percussion drilling assemblies. Consequently, upper end 140*a* of driver sub 140 may also be described as comprising a "guide" or "guide sleeve." Unlike most conventional percussion drilling assemblies that include a separate and distinct driver sub and guide sleeve axially separated by the retainer ring, in this embodiment, the separate guide sleeve is eliminated. Specifically, the function of the conventional guide sleeve is performed by upper end 140*a* of a unitary driver sub 140.

A bit retainer ring 134 is positioned within case 130 about the upper end of hammer bit 160. As best shown in FIG. 5, the outer radial portion of retainer ring 134 is disposed in an annular recess 142 formed in the inner surface of driver sub 140, and the inner radial portion of retainer ring 134 is positioned in an annular recess 168 in the outer surface of hammer bit 160. The axial position of retainer ring 134 is fixed relative to driver sub 140 via recess 142. Although hammer bit 160 moves axially relative to bit retainer ring 134 and driver sub 140, since bit retainer ring 134 extends radially into annular recess 168 of hammer bit 160, bit retainer ring 134 restricts disengagement of hammer bit 160 from driver sub 140 and the remainder of assembly 100. It should also be appreciated that positioning of retainer ring 134 within annular recess 142 reduces the likelihood of any portion of retainer ring 134 from being lost into the well bore in the event of inadvertent unthreading and disengagement of driver sub 140 from case 130. Thus, unlike the conventional retainer ring that engages the inner surface of the case and is not disposed radially within the driver sub, in this embodiment, retainer ring 134 is disposed radially within driver sub 140 and engages the inner surface of driver sub 140.

Referring still to FIGS. 4 and 5, top sub 120 includes a central passage 125 in fluid communication with drillstring 11. The upper end of fluid conduit 150 is received by the lower end of passage 125, and is coupled to top sub 120 with a pin 122 extending through top sub 120 and fluid conduit 150. A check valve 157 is coupled to the upper end of feed tube 150 and allows one-way fluid communication between passage 125 and fluid conduit 150. When check valve 157 is in the opened position, drillstring 11 and fluid conduit 150 are in fluid communication via passage 125. However, when check valve 157 is in the closed position, fluid communication between drillstring 11 and fluid conduit 150 is restricted. In this manner, check valve 157 restricts the back flow of cuttings from the wellbore into drillstring 11. The lower end of feed tube 150 includes circumferentially spaced radial outlet ports 151, 152 and an axial bypass choke 155.

Piston 135 is slidingly disposed in case 130 above hammer bit 160 and cyclically impacts hammer bit 160. A central passage 133 in piston 135 slidingly receives the lower end of feed tube 150. Piston 135 also includes a first flow passage 136 extending from central passage 133 to a lower chamber 138, and a second flow passage 137 extending from central passage 133 to an upper chamber 139. Lower chamber 138 is defined by case 130, the lower end of piston 135, and driver sub 140, and upper chamber 139 is defined by case 130, the upper end of piston 135, and the lower end of top sub 120.

During drilling operations, piston 135 is reciprocally and axially actuated within case 130 by alternating the flow of the compressed fluid (e.g., pressurized air) between passage 136, 137 and chambers 138, 139, respectively. More specifically, piston 135 has a first axial position with outlet port 151 axially aligned with passage 136 (FIG. 4), thereby placing first outlet port 151 in fluid communication with passage 136 and chamber 138, and a second axial position with second outlet port 152 axially aligned with passage 137, thereby placing second outlet port 152 in fluid communication with passage 137 and chamber 139. The intersection of passages 133, 136 is axially spaced from the intersection of passages 133, 137, and thus, when first outlet port 151 is aligned with passage 136, second outlet port 152 is out of alignment with passage 137 and vice versa. It should be appreciated that piston 135 assumes a plurality of axial positions between the first position and the second position, each allowing varying degrees of fluid communication between ports 151, 152 and passage 136, 137, respectively.

Referring still to FIGS. 4 and 5, the inner surface of driver sub 140 and the outer surface of hammer bit 160 include axially oriented mating splines 141, 161, respectively. Internal splines 141 of driver sub 140 extend axially from proximal lower end 140*b* to annular recess 142. However, internal splines 141 do not extend axially beyond annular recess 142 to upper end 140*a*. Hammer bit 160 slidingly engages driver sub 140. More specifically, the series of generally axial mating splines 161, 141 on bit 160 and driver sub 140, respectively, allow bit 160 to move axially relative to driver sub 140 while simultaneously allowing driver sub 140 to rotate bit 160 with drillstring 11 and case 130.

A retainer sleeve 170 is coupled to lower end 140*b* of driver sub 140 and extends along the outer periphery of hammer bit 160. Retainer sleeve 170 has an upper end 170*a* disposed about and coupled to lower end 140*b* of driver sub 140, and a lower end 140*b* extending axially below driver sub 140 along the outside of hammer bit 160. As described in U.S. Pat. No. 5,065,827, which is hereby incorporated herein by reference in its entirety, the retainer sleeve 170 generally provides a secondary catch mechanism that allows the lower enlarged head of hammer bit 160 to be extracted from the wellbore in the event of a breakage of the shank (rotational drive) section of hammer bit 160.

As best shown in FIGS. 4 and 5, hammer bit 160 also includes a central longitudinal passage 165 in fluid communication with downwardly extending passages 166 having ports or nozzles 166*a* formed in the face of hammer bit 160. Bit passage 165 is also in fluid communication with piston passage 133. Fluid communication is maintained between bores 133, 165 as piston 135 moves axially upward relative to hammer bit 160. Compressed fluid exhausted from chambers 138, 139 into piston passage 133 of piston 135 flows through bit passages 165, 166 and out ports or nozzles 166*a* in bit face 164. Together, passages 166 and the nozzles 166*a* serve to distribute compressed fluid around the face of bit 160 to flush away formation cuttings during drilling and to remove heat from bit 160.

During drilling operations, drillstring 11 and drilling assembly 100 are rotated. Mating splines 161, 141 on bit 160 and driver sub 140, respectively, allow bit 60 to move axially relative to driver sub 140 while simultaneously allowing driver sub 140 to rotate bit 160 with drillstring 11. The rotation of hammer bit 60 allows the cutting elements (not shown) of bit 160 to be "indexed" to fresh rock formations during each impact of bit 160, thereby improving the efficiency of the drilling operation.

In this embodiment, compressed fluid (e.g., compressed air or nitrogen) flows axially down drillstring 11, passage 125, and fluid conduit 150. At the lower end of fluid conduit 150, the compressed fluid flows radially outward through ports 151, 152, passages 136, 137, respectively, to chamber 138, 139, respectively, thereby actuating piston 135. In such percussion drilling assembly designs in which the compressed fluid flows down the drillstring and radially outward to the piston-cylinder chambers, the fluid conduit extending between the top sub and the piston is generally referred to as a "feed tube." In other embodiments, the percussion drilling assembly may alternatively utilize an air distributor design, in which compressed air is directed radially inward from an outer radial location into the upper and lower piston-cylinder chambers to actuate the piston. Embodiments described herein may be employed in either feed tube design or air distributor design percussion drilling assemblies.

As previously described, in most conventional hammer bit assemblies, the driver sub (e.g., driver sub 40) and the guide sleeve (e.g., guide sleeve 32) are designed and manufactured as separate and distinct components axially separated by the bit retainer ring. Further, the conventional driver sub and guide sleeve are manufactured with dimensional tolerances sufficient to permit movement of these components within the percussion drilling assembly following installation. The movement of the driver sub and the guide sleeve during drilling operations may detrimentally wear the mating surfaces of the guide sleeve and the driver sub, thereby further increasing the tolerances with neighboring components and further exacerbating the movement and associated wear. Excessive wear over extended drilling operations may result in damage and/or breakage of the guide sleeve and/or driver sub, potentially requiring a costly and time consuming trip of the drillstring and fishing expedition to recover the hammer bit. To the contrary, embodiments described herein eliminate the need for a separate and distinct guide sleeve by employing a unitary driver sub 140 having an upper end 140*a* that slidingly engages and guides the lower end of piston 135. By reducing the number of moving components in percussion drilling assembly 100, embodiments described herein offer the potential to reduce the likelihood of excessive wear and associated damage to individual components of the assembly. In particular, for a given manufacturing dimensional tolerance, by eliminating the separate and distinct guide sleeve, embodiments described herein foreclose the possibility of the driver sub and the guide sleeve moving relative to each other. Moreover, as driver sub 140 is threaded into case 130, movement between driver sub 140, and its upper end 140*a*, and case 130 is eliminated.

Figure 3:
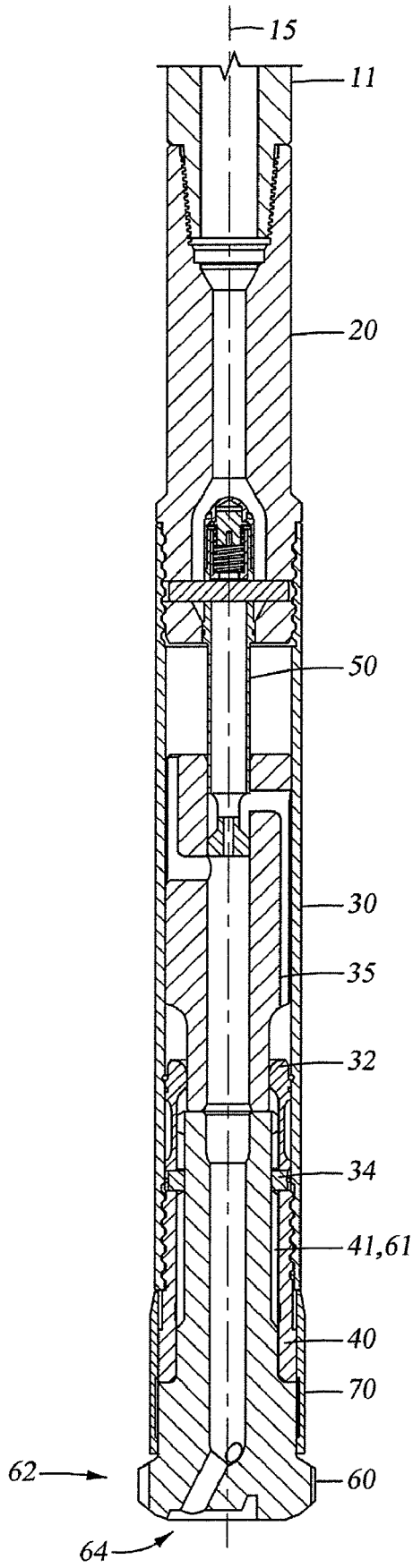
Fig. 3 PRIOR ART
FIG. 3 is a cross-sectional view of the percussion drilling assembly of FIG. 1 connected to the lower end of a drillstring.

As previously described, in embodiments described herein, bit retainer ring 134 is disposed radially within driver sub 140 and in particular, within annular recess 142 of driver sub 140. To accommodate such an arrangement, embodiments of percussion drilling assembly 100 may be assembled in a different manner than conventional percussion drilling assemblies. Specifically, and referring to FIGS. 1 and 3, in most conventional percussion drilling assemblies (e.g., assembly 10), the upper end of the hammer bit (e.g., hammer bit 60) is advanced into the lower end of the driver sub (e.g., driver sub 40) such that the mating splines engage (e.g., splines 41, 61). Then, a two piece retainer ring (e.g., retainer ring 34) is disposed about the upper end of the hammer bit, axially above the driver sub; each half of the retainer ring is disposed about the hammer bit and advanced radially inward toward each other until the ends of the halves nearly contact each other, thereby substantially encircling the hammer bit and completing a bit subassembly. The guide sleeve (e.g., guide sleeve 70) may be hung from the driver sub prior to or after the retainer ring is positioned about the upper end of the hammer bit.

Next, the guide sleeve (e.g., guide sleeve 32) is independently axially advanced into the case (e.g., case 30), until it engages a mating shoulder or ring in the case (not shown), thereby completing a case subassembly. The bit subassembly (including the bit, the driver sub, and the retaining ring) is then advanced axially into the case subassembly (including the case and the guide sleeve), and the driver sub is threaded to the lower end of the case, thereby urging the retainer ring into engagement with the lower end of the guide sleeve.

Figure 6:
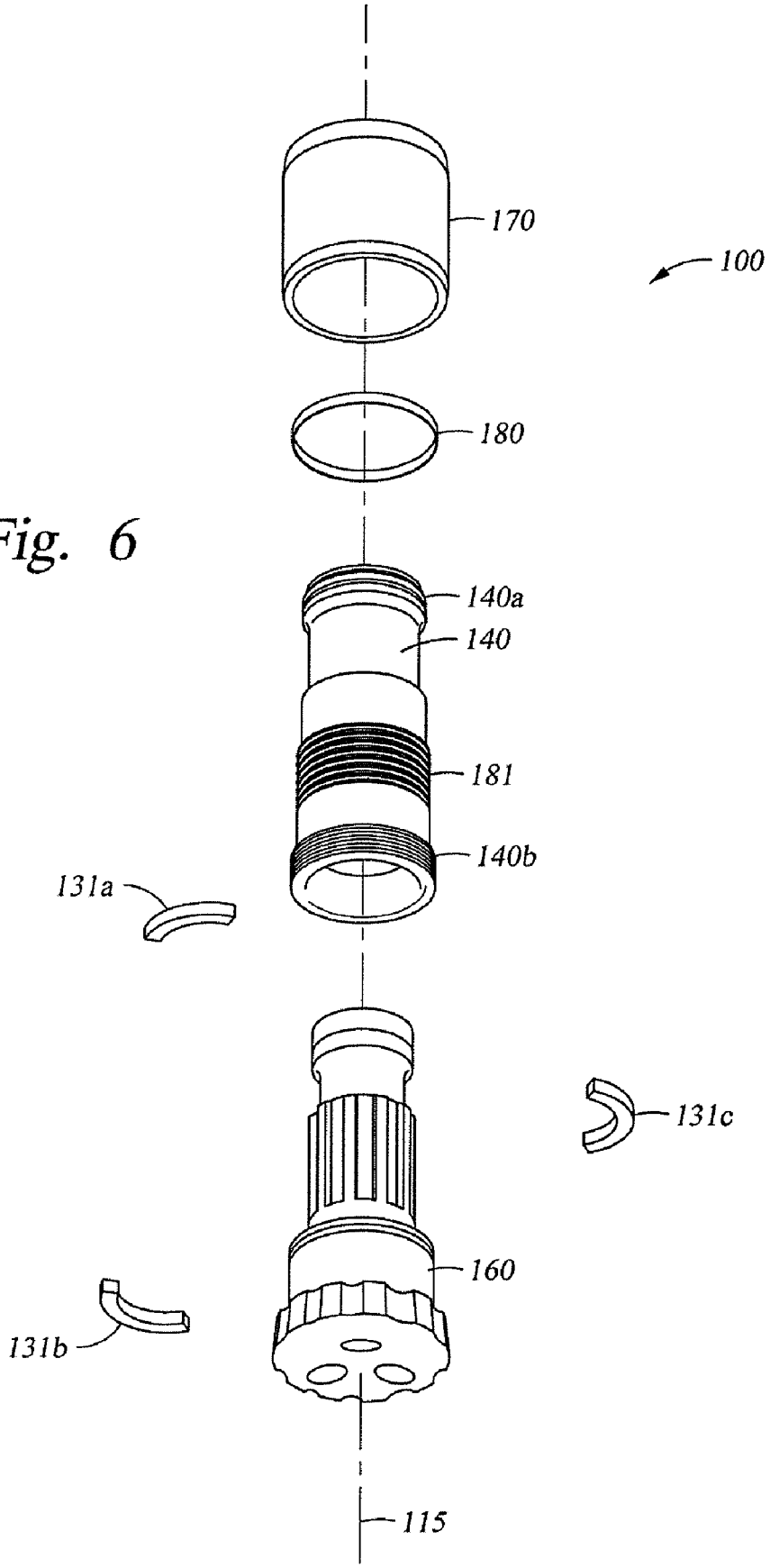
FIG. 6 is an exploded, partial perspective view of the percussion drilling assembly of FIG. 5.

Referring now to FIGS. 4-6, in embodiments described herein (e.g., assembly 100), the outer diameter of retainer ring 134 is substantially the same or slightly less than the inner diameter of annular recess 142 in the inner surface of driver sub 140. Thus, the outer radius of retainer ring 134 is greater than the inner radius of the remainder of driver sub 140. As a result, once retainer ring 134 is disposed within recess 142, its axial movement relative to driver sub 140 is restricted. In addition, the inner diameter of retainer ring 134 is substantially the same or slightly greater than the outer diameter of annular recess 168 in hammer bit 160. Thus, the inner diameter of retainer ring 134 is less than the outer radius of the remainder of hammer bit 160. As a result, once retainer ring 134 is disposed within recess 168, hammer bit 160 is restricted from disengaging the remainder of assembly 100. As retainer ring 134 extends into both annular recesses 134, 168, retainer ring 134 cannot be disposed about hammer bit 160 in annular recess 168 and then advanced into driver sub 140, and further, retainer ring 134 cannot be disposed within recess 142 of driver sub 140 and then advanced over hammer bit 160. Consequently, as will be described in more detail below, embodiments described herein are assembled in a manner different than most conventional percussion drilling assemblies (e.g., percussion drilling assembly 10).

As best shown in FIGS. 5 and 6, in this embodiment, bit retainer ring 134 comprises a plurality of retainer ring segments 134*a, b, c*, and driver sub 140 comprises a retainer ring access slot 144 through which retainer ring segments 134*a, b, c* are installed and removed. Retainer ring access slot 144 is axially aligned with annular recess 142 and extends radially completely through driver sub 140 from the outer surface of driver sub 140 to annular recess 142. In addition, access slot 144 is axially aligned with annular recess 168 in the outer surface of upper end 160*a* of bit 160. Accordingly, access slot 144 provides external access to annular recesses 142, 168 following insertion of hammer bit 160 into driver sub 140. Retainer ring access slot 144 is preferably axially and circumferentially sized to accommodate each retainer ring segment 134*a, b, c*. As there are three retainer ring segments 134*a, b, c* in this embodiment, each retainer ring segment 134*a, b, c* makes up about $\frac{1}{3}^{rd}$ or 120° of retainer ring 134. Accordingly, in this embodiment, retainer ring access slot 144 circumferentially extends about 120° or less about driver sub 140.

Retainer ring 134 is formed by inserting retainer ring segments 134*a, b, c* one at a time through access slot 144 into axially aligned recesses 142, 168, and then circumferentially advancing each retainer ring segment 134*a, b, c* through recesses 142, 168. As the each successive retainer ring segment 134*a, b, c* is inserted through access slot 144 and circumferentially slid through recesses 142, 168, its leading end engages and pushes the trailing end of the previously inserted retainer ring segment 134*a, b, c* through the remainder of recess 142. In this manner, the insertion and circumferential advancement of each retainer ring segment 134*a, b, c* through recess 142 and annular recess 168 results in the assembly of retainer ring 134 radially disposed between hammer bit 160 and driver sub 140 within annular recess 142 and annular recess 168.

Although three retainer ring segments 134*a, b, c* are shown and described in FIG. 6, in other embodiments, any suitable number of retainer ring segments may be provided (e.g., two, three, four, five, or more). Further, the circumferential length of the access slot (e.g., slot 144) may be varied as appropriate to accommodate the retainer ring segments. The circumferential length and axial width of the access slot 144 is preferably minimized to reduce the likelihood of any structural weakening of driver sub 140.

In this embodiment, an annular band 180 is disposed about driver sub 140 following insertion of retainer ring segments 134*a, b, c* into annular recess 142 and assembly of retainer ring 134. Specifically, band 180 is disposed in a mating recess 181 formed in the outer surface of driver sub 140. Band 180 and recess 181 are axially aligned with access slot 144, and thus, band 180 extends circumferentially across access slot 144. As a result, band 180 effectively closes off access slot 144, thereby maintaining the radial position of retaining ring segments 134*a, b, c* within recess 142, and restricting retaining ring segments 134*a, b, c* from moving radially outward from recess 142. Band 180 may comprise a unitary ring or a split ring. In general, band 180 may be made from any suitable material, but preferably comprises an elastomeric material or flexible metal. It should be appreciated that band 180 and mating recess 181 are shielded from conditions in the borehole by case 130. In particular, once percussion drilling assembly 100 is assembled, band 180 is positioned within case 130, radially between case 130 and driver sub 140. In other embodiments, the bit retaining ring segments (e.g., retaining ring segments 134*a, b, c*) may be retained within the recess in the inner surface of the driver sub (e.g., driver sub 140) and restricted from moving radially outward through the access slot (e.g., access slot 144) by closing off the access slot with a plug (e.g., plug welded in the slot).

Accordingly, percussion drill bit assembly 100 is assembled by inserting drill bit 160 into driver sub 140 such that mating splines 141, 161 engage and annular recess 168 is generally axially opposed access slot 144 and recess 142. Then, retainer ring segments 134*a, b, c* are inserted through slot 144 into annular recess 142 one at a time, and circumferentially advanced through recess 142 to form retainer ring 134. Retainer sleeve 170 may be disposed about and hung from driver sub 140 prior to or after assembly of retainer ring 134. Next, the hammer bit 160, driver sub 140, and retainer ring 134 subassembly is axially advanced into lower end 130*b* of case 130 and driver sub 140 is threadingly coupled to lower end 130*b* of case 130.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A percussion drilling assembly for boring into the earth, the percussion drilling assembly comprising:

a tubular case having a central axis, an upper end, and a lower end;

a piston slidingly disposed within the tubular case;

a driver sub coaxially coupled to the lower end of the tubular case, the driver sub including an upper end disposed within the case and a lower end extending axially from the lower end of the case, and at least one internal spline disposed on an inner surface of the driver sub;

a hammer bit coaxially disposed within the driver sub, the hammer bit including an upper end disposed within the driver sub and a lower end extending from the lower end of the driver sub, and at least one external spline disposed on an outer surface of the hammer bit, the external spline configured to engage the at least one internal spline of the driver sub;

wherein the upper end of the driver sub extends axially from the upper end of the hammer bit and is configured to guidingly receive the piston;

a bit retainer ring including a plurality of retainer ring segments, the bit retainer ring radially positioned between the hammer bit and the driver sub, wherein the bit retainer ring is adapted to restrict the de-coupling of the hammer bit and the driver sub;

wherein the inner surface of the driver sub includes an annular recess, and wherein the bit retainer ring extends radially into the annular recess of the driver sub; and wherein the driver sub further comprises an access slot axially aligned with the annular recess in the inner surface of the driver sub, such that the access slot extends radially from an outer surface of the driver sub to the annular recess in the inner surface of the driver sub and is configured for insertion of the plurality of retainer ring segments into the annular recess.

2. The percussion drilling assembly of claim 1, wherein the outer surface of the upper end of the hammer bit includes an annular recess, and wherein the bit retainer ring extends radially into the annular recess of the hammer bit.

3. The percussion drilling assembly of claim 1, further comprising an annular band disposed about the driver sub and extending circumferentially across the access slot.

4. The percussion drilling assembly of claim 3, wherein the annular band is disposed in a recess in an outer surface of the driver sub.

5. The percussion drilling assembly of claim 1 wherein the retainer ring comprises a plurality of retainer ring segments.

6. The percussion drilling assembly of claim 1, wherein the retainer ring has an inner diameter that is substantially the same as the outer diameter of the annular recess of the hammer bit and an outer diameter that is substantially the same as the inner diameter of the annular recess of the driver sub.

7. A percussion drilling assembly for boring into the earth, the percussion drilling assembly comprising:

a tubular case having a central axis, an upper end, and a lower end;

a piston slidingly disposed in the tubular case;

a driver sub connected to the lower end of the tubular case, the driver sub comprising at least one internal spline disposed on an inner surface of the driver sub;

a hammer bit coaxially disposed within the driver sub, the hammer bit including an upper end disposed within the driver sub and a lower end extending from the lower end of the driver sub, and at least one external spline disposed on an outer surface of the hammer bit, the external spline configured to engage the at least one internal spline of the driver sub; and a bit retainer ring radially disposed between the inner surface of the driver sub and the outer surface of the hammer bit, the bit retainer ring having a plurality of retainer ring segments;

an annular recess in the inner surface of the driver sub, wherein the bit retainer ring is disposed in the annular recess; and wherein the driver sub includes a slot extending radially from an outer surface of the driver sub to the annular recess of the driver sub and extending circumferentially about a portion of the driver sub and is configured for insertion of the plurality of retainer ring segments into the annular recess.

8. The percussion drilling assembly of claim 7, wherein the driver sub has an upper end that extends axially beyond an upper end of the hammer bit, the upper end of the driver sub adapted to receive a lower end of the piston.

9. A method for assembling a percussion drilling assembly, comprising:

(a) slidingly receiving an upper end of a hammer bit into a driver sub and engaging at least one external spline of the hammer bit with at least one internal spline of the driver sub, wherein the hammer bit has an outer surface including an annular recess and the driver sub has an inner surface including an annular recess;

(b) advancing the hammer bit axially through the driver sub until the annular recess of the driver sub aligns with the annular recess of the hammer bit; and (c) positioning a bit retainer ring radially between the driver sub and the hammer bit in the annular recess on the outer surface of the hammer bit and the annular recess on the inner surface of the driver sub after (b);

(d) coupling a retainer sleeve to a lower end of the driver sub;

(e) disposing a piston within a tubular case; and (f) coupling the driver sub to a lower end of a tubular case with mating threads;

wherein the driver sub includes a slot extending radially from an outer surface of the driver sub to the annular recess in the inner surface of the driver sub;

wherein the retainer ring comprises a plurality of retainer ring segments; and wherein (c) further comprises:

inserting a first of the plurality of retainer ring segments radially into the slot;

inserting the first of the plurality of retainer ring segments radially through the slot and into the annular recess in the hammer bit; and advancing the first of the plurality of retainer ring segments circumferentially through the annular recess in the hammer bit and the driver sub.

10. The method of claim 9 further comprising receiving a lower end of the piston in an upper end of the driver sub.

11. The method of claim 9 wherein (c) further comprises:

inserting a second of the plurality of retainer ring segments radially into the slot;

inserting the second of the plurality of retainer ring segments radially through the slot and into the annular recess in the hammer bit;

advancing the second of the plurality of retainer ring segments circumferentially through the annular recess in the hammer bit and the driver sub.

12. The method of claim 11 further comprising closing off the slot.

13. The method of claim 12 further comprising disposing a band about the driver sub, wherein the band extends circumferentially across the slot.

* * * * *